US009075395B2

(12) United States Patent
Cabezas Jurin et al.

(10) Patent No.: US 9,075,395 B2
(45) Date of Patent: Jul. 7, 2015

(54) TIMEPIECE PALLET LEVER WITH OPTIMISED HORNS

(71) Applicant: ETA SA Manufacture Horlogere Suisse, Grenchen (CH)

(72) Inventors: Andres Cabezas Jurin, Yverdon-les-Bains (CH); Arthur Queval, Lutry (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/514,549

(22) Filed: Oct. 15, 2014

(65) Prior Publication Data

US 2015/0124570 A1 May 7, 2015

(30) Foreign Application Priority Data

Nov. 6, 2013 (EP) ..... 13191770

(51) Int. Cl.
*G04B 15/08* (2006.01)
*G04B 15/14* (2006.01)

(52) U.S. Cl.
CPC ..... *G04B 15/14* (2013.01); *G04B 15/08* (2013.01)

(58) Field of Classification Search
CPC ..... G04B 15/08; G04B 15/14
USPC ..... 368/129–133
See application file for complete search history.

(56) References Cited

U.S. PATENT DOCUMENTS

| | | | | | |
|---|---|---|---|---|---|
| 179,769 | A * | 7/1876 | Champod | 368/133 |
| 194,744 | A * | 8/1877 | Thompson | 368/132 |
| 372,003 | A * | 10/1887 | Woerd | 368/133 |
| 725,037 | A * | 4/1903 | Buysse | 368/127 |
| 1,105,062 | A * | 7/1914 | Cochran | 368/131 |
| 3,225,866 | A | 12/1965 | Bernett et al. | |
| 3,845,616 | A | 11/1974 | Jeanmairet et al. | |
| 2008/0101162 | A1 * | 5/2008 | Born | 368/132 |

FOREIGN PATENT DOCUMENTS

| | | |
|---|---|---|
| CH | 286 179 | 10/1952 |
| CH | 699 273 B1 | 2/2010 |
| FR | 206 876 | 10/1890 |
| FR | 2 203 104 | 5/1974 |

OTHER PUBLICATIONS

European Search Report issued May 20, 2014 in European Application 13191770, filed on Nov. 6, 2013 ( with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

Pallet lever for an escapement mechanism including a balance with a pin of a given pin radius and oscillating over a given radius of gyration, this pallet lever including two horns for cooperation with a pin of this type. These horns are symmetrical to each other relative to a median plane passing through a pallet lever pivot axis, and each includes a concave inner profile over a first radius of curvature greater than or equal to the sum of this radius of gyration and this pin radius, this concave inner profile being adjacent to a convex outer profile over a second radius of curvature less than or equal to the difference between this radius of gyration and this pin radius.

15 Claims, 3 Drawing Sheets

TIMEPIECE PALLET LEVER WITH OPTIMISED HORNS

This application claims priority from European Patent Application No. 13191770.0 filed Nov. 6, 2013, the entire disclosure of which is hereby incorporated herein by reference.

FIELD OF THE INVENTION

The invention concerns a pallet lever for a timepiece escapement mechanism including a balance provided with a pin of a given radius and oscillating over a given radius of gyration, said pallet lever including, on either side of an aperture, a first horn and a second horn for cooperation with a pin of this type.

The invention also concerns a balance provided with a pin of a given pin radius and oscillating over a given radius of gyration about a balance pivot axis.

The invention also concerns an escapement mechanism including a balance pivoting about a balance pivot axis and provided with a pin of a given radius on a given radius of gyration, and a pallet lever of this type.

The invention also concerns a mechanical timepiece movement including at least one such escapement mechanism.

The invention also concerns a watch including at least one mechanical timepiece movement of this type.

The invention concerns the field of timepiece escapement mechanisms.

BACKGROUND OF THE INVENTION

In a watch provided with an escapement, particularly a Swiss lever escapement, the escapement functions must be maintained regardless of any shocks experienced by the watch. The escapement must be robust and capable of resisting axial and radial shocks, in all positions of the watch. To achieve this, mechanical elements, called escapement safety devices, limit the travel of rotating or oscillating elements, in order to avoid any critical position which could either disrupt operation or stop the watch.

In particular, in a Swiss lever escapement, these safety functions are ensured by at least the horns and the guard pin. The reliability and robustness of this system are proven, but it nonetheless requires distinct components, which increases production costs and the risk of non-quality. The fact of arranging the horns and the guard pin on two distinct levels requires sufficient division, which has a significant impact on the height of the movement, and thus on the final thickness of the watch.

FR Patent No 206 876 in the name of WALD discloses a pallet lever with two horns that are symmetrical relative to a median plane, each with a concave inner profile and a convex outer profile.

SUMMARY OF THE INVENTION

The invention proposes to improve the design of safety devices, by combining the safety functions of the horns and of the guard pin of a lever escapement, regardless of whether it is a Swiss lever, English lever, pin pallet, or similar escapement.

The invention optimises the design of the horns, so as to ensure the safety functions which, until now, were attributed to the guard pin, intended to prevent accidental movements of the pallet fork during the supplementary arc of oscillation of the balance. The pallet lever according to the invention is thus a lever with no guard pin.

The pallet lever according to the invention is on a single level, owing to a particular shape of the horns, known as "crab claws", which alone perform all of the safety functions.

The invention makes it possible to simplify not only the pallet lever, which can henceforth be made on a single level, which allows the use of all conceivable manufacturing techniques, but also the balance, since the safety roller is no longer necessary due to the disappearance of the guard pin from the lever. Only the roller, or depending on the case, an arm, carrying the impulse pin, remains necessary. The thickness of the balance can thus be reduced.

To this end, the invention concerns a pallet lever for a timepiece escapement mechanism including a balance provided with a pin of a given pin radius and oscillating over a given radius of gyration, said pallet lever including, on either side of an aperture, a first horn and a second horn for cooperation with a pin of this type, characterized in that said horns have a symmetrical profile to each other relative to a median plane passing through a pallet lever pivot axis, and each include a concave inner profile over a first cylindrical sector bordering said aperture and having a first radius of curvature greater than or equal to the sum of said radius of gyration and said pin radius, said concave inner profile being adjacent to a convex outer profile over a second cylindrical sector having a second radius of curvature less than or equal to the difference between said radius of gyration and said pin radius and opposite said aperture.

The invention also concerns a balance provided with a pin of a given pin radius and oscillating over a given gyration radius about a balance pivot axis, characterized in that said balance includes a single roller carrying said pin.

The invention also concerns an escapement mechanism including a balance pivoting about a balance pivot axis and provided with a pin of a given radius on a given radius of gyration, and a pallet lever of this type.

The invention also concerns a mechanical timepiece movement including at least one such escapement mechanism.

The invention also concerns a watch including at least one mechanical timepiece movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
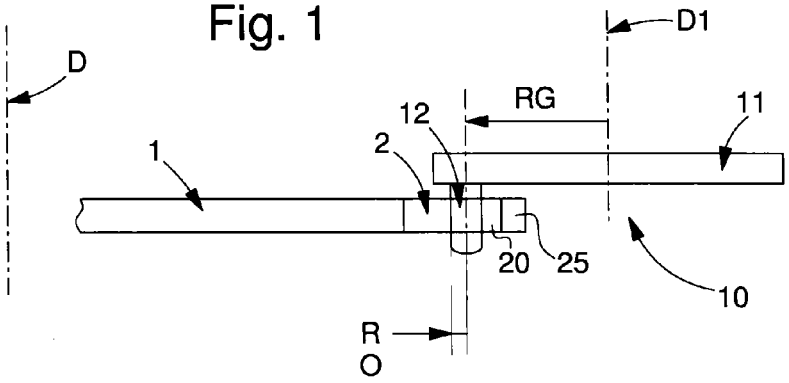
FIG. 1 shows a schematic, partial cross-section, in a plane passing through a balance pivot axis and a pallet lever pivot axis, of a detail of an escapement mechanism according to the invention, including a pallet lever with no guard pin, and a balance with no safety roller.

The invention concerns the field of timepiece escapement mechanisms. The invention improves the design of safety devices, by combining the safety functions of the horns and guard pin of a lever escapement. The invention is more precisely described in the preferred and more usual, but non-limiting case, of the Swiss lever.

The invention thus concerns a pallet lever 1, in particular a Swiss lever, for a timepiece escapement mechanism 10, which includes a balance 11 provided with a pin 12 of a given pin radius R0, said balance 11 oscillating over a given radius of gyration RG.

Pallet lever 1 according to the invention is preferably devised for a given type of balance, according to these parameters, having a given pin radius R0 and a given radius of gyration RG.

Pallet lever 1 includes, on either side of an aperture 3, a first horn 2A and a second horn 2B for cooperation with a pin 12 of this type.

The sizing of aperture 3 depends on the cooperation with balance 11, and also on the lever arm L of the pallet lever head relative to a pallet lever pivot axis D.

When pallet lever 1 pivots about this pallet lever pivot axis D, horns 2A, 2B each describe a circular trajectory.

Figure 2:
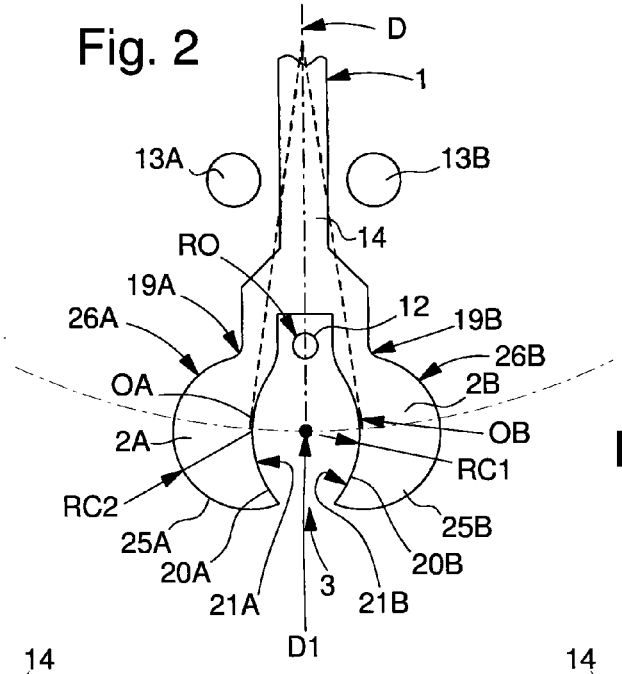
FIG. 2 shows a schematic, partial and plan view of one end of a pallet lever with no guard pin having optimised horns according to the invention, in a symmetrical locking position between two banking stop members.

According to the invention, and as seen in FIG. 2, the first horn 2A and second horn 2B have a symmetrical profile to each other relative to a median plane P passing through pallet lever pivot axis D. First horn 2A and second horn 2B each include:

- a concave inner profile 20 over a first cylindrical sector 21 bordering aperture 3 and having a first radius of curvature RC1. This first radius of curvature RC1 is greater than or equal to the sum of radius of gyration RG and pin radius R0;
- this concave inner profile 20 being adjacent to a convex outer profile 25 over a second cylindrical sector 26 having a second radius of curvature RC2. This second radius of curvature R2 is less than or equal to the difference between radius of gyration RG and pin radius R0; this second cylindrical sector 26 is located opposite aperture 3.

In a particular embodiment, the first radius of curvature RC1 is equal to the sum of radius of gyration RG, pin radius R0 , and of a horn endshake EC, and the second radius of curvature RC2 is equal to the difference between, on the one hand, radius of gyration RG and on the other hand, the sum of pin radius R0 and horn endshake EC. Preferably, horn endshake EC is less than or equal to 0.050 mm.

Concave inner profile 20 and convex outer profile 25 are thus arranged in relation to each other so that a cylinder parallel to pallet lever pivot axis D and having a radius equal to radius of gyration RG is at a distance, to within the horn endshake, of the value of pin radius R0, of a profile resulting from the combination between, on one hand the convex outer profile 25A, 25B of one of horns 2A, 2B, and on the other hand the concave inner profile 20B, 20A, of the other of horns 2B, 2A, so that concave inner profile 20 and convex outer profile 25 are tangential to the trajectory 15 or 16 of a pin 12 of a balance 11 of this type whose balance pivot axis D1 is located in the median plane P in a symmetrical locking position of escapement mechanism 10, seen in FIG. 2.

Thus, in a first part of the oscillation of balance 11, this concave inner profile 20 prevents any overbanking of pallet lever 1 in the event of a shock, and, in a second part of the oscillation of balance 11, corresponding to the remainder of its oscillation, this convex outer profile 25 in turn prevents any overbanking of pallet lever 1 in the event of a shock.

Figure 3:
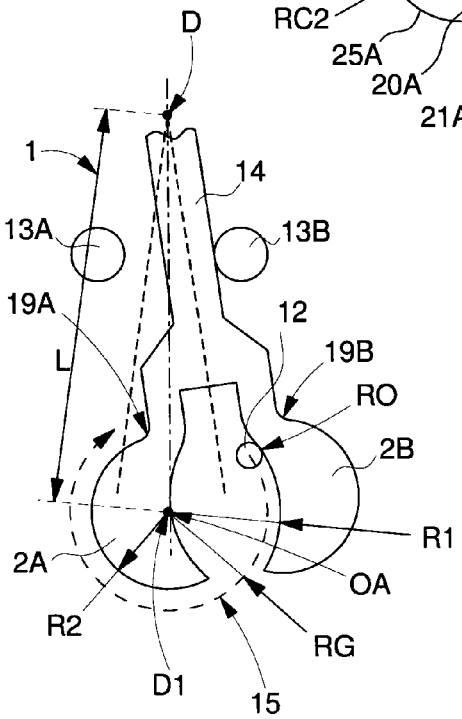
FIG. 3 shows, in a similar manner to FIG. 3, the same pallet lever in a position bearing against a stop member during an oscillation in the clockwise direction.
Figure 4:
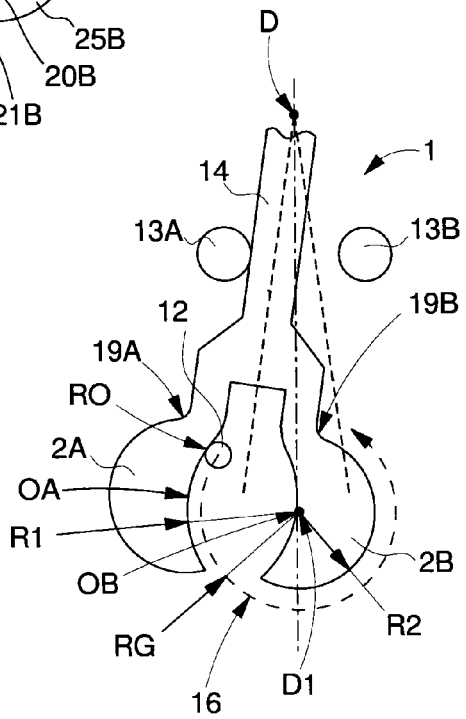
FIG. 4 shows, in a similar manner to FIG. 3, the same pallet lever in a position bearing against a stop member during an oscillation in the anti-clockwise direction.

FIG. 3 illustrates a pallet lever 1 of this type, in a position bearing against a limit stop 13B of escapement mechanism 10 during an oscillation in the clockwise direction, the trajectory 15 of pin 12 is shown in a dotted line, and, likewise, FIG. 4 shows the same pallet lever 1 in a position bearing against a limit stop 13A of escapement mechanism 10, during an oscillation in the clockwise direction, the trajectory 16 of pin 12 is shown in dotted lines.

Preferably, pallet lever 1 includes, at the ends of the outer profiles 25A; 25B closest to pallet lever pivot axis D, end of travel areas 19A, 19B which are arranged to form stop members for a pin 12 of this type.

In a preferred embodiment, as seen in FIGS. 2 to 4, the concave inner profile 20 of each of horns 2A, 2B, is centred on the concave inner profile of the opposite horn respectively 2B, 2A, at a centre OB, OA which is also the centre of convex outer profile 25 of the horn considered 2A, 2B.

Figure 6:
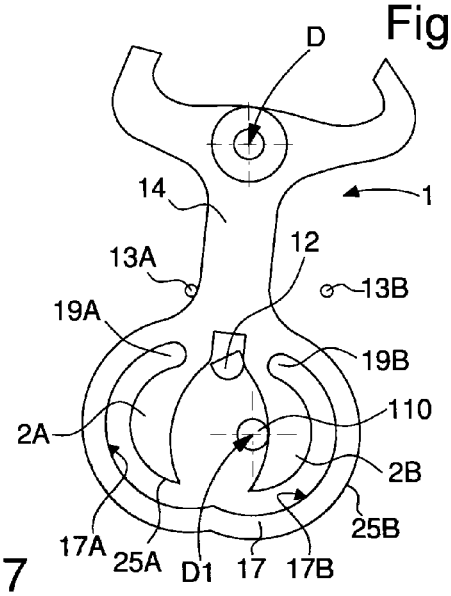
FIG. 6 shows a schematic, plan view of a Swiss lever with no guard pin having optimised horns according to the invention, and including an outer ring limiting the travel of the pin, in a position bearing against a stop member during an oscillation in the anti-clockwise direction.

FIG. 6 illustrates a Swiss lever 1, which includes, around horns 2A, 2B, an outer ring 17 limiting the pin travel, including a first inner limiting surface 17A facing the convex outer profile 25A of first horn 2A, and a second inner limiting surface 17B facing convex outer profile 25B of the second first horn 2B. In a particular embodiment of this variant, the space between outer ring 17 and convex outer profiles 17A, 17B, is equal to twice the pin radius R0 plus a radial play J less than or equal to 0.100 mm. In this variant, safety is further increased, particularly when a shock occurs when pin 2 leaves the distal end of one of the horns before rejoining the opposite horn.

Figure 7:
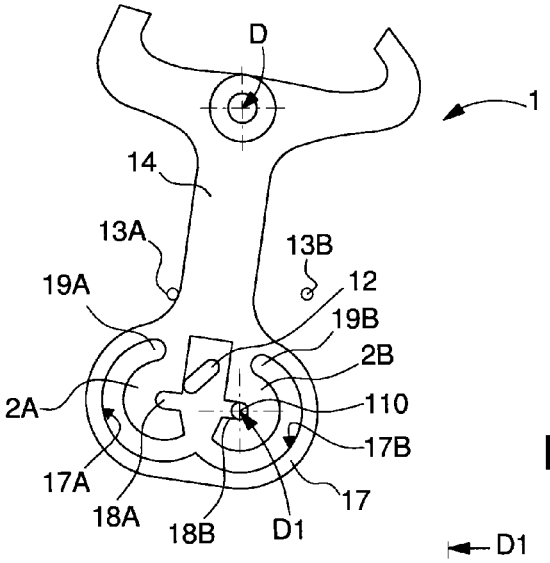
FIG. 7 shows a schematic, plan view of a Swiss lever with no guard pin having optimised horns according to the invention, and including an outer ring limiting the travel of the pin, and further including notches sized for the passage of a balance staff, in a position bearing against a stop member during an oscillation in the anti-clockwise direction.
Figure 8:
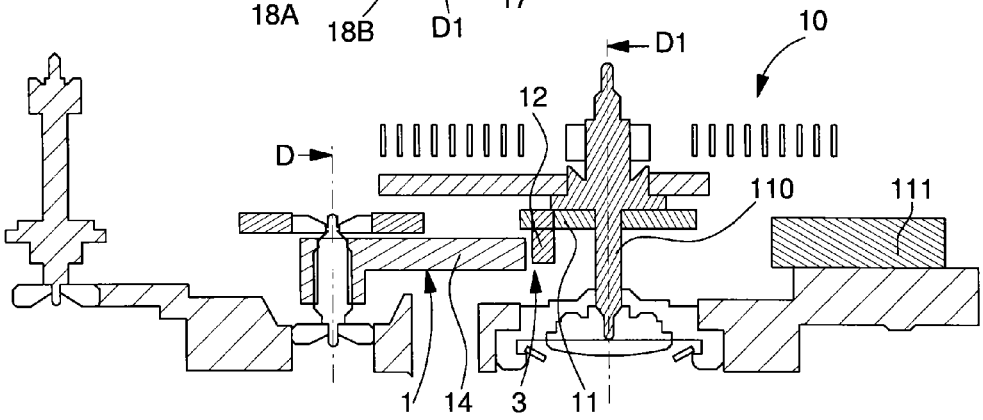
FIG. 8 shows a schematic, partial cross-section, in a plane passing through a balance pivot axis and a pallet lever pivot axis, of a detail of an escapement mechanism according to the invention, including a pallet lever with no guard pin, and a balance with no safety roller.

FIG. 7 illustrates a Swiss lever, which is a variant of the FIG. 6 lever, and which includes, on each of concave inner profiles 20A, 20B, a notch 18A, 18B which is sized for the passage of a staff 110 of a balance 11 of this type. These notches may also be made in other lever variants such as those of FIGS. 2 to 5.

Preferably, in these different embodiments, pallet lever 1 according to the invention is flat and has no guard pin.

The invention also concerns a balance 11 provided with a pin 12 of a given pin radius R0 and oscillating over a given radius of gyration RG about a balance pivot axis D1. According to the invention, balance 11 includes a single roller carrying pin 12. This balance 11 is suitable for cooperating with a pallet lever 1 of the type described above.

In a particular embodiment, the single roller carrying pin 12 is formed by the felloe of balance 11.

The invention further concerns an escapement mechanism 10 including a balance 11 pivoting about a balance pivot axis D1 and provided with a pin 12 of a given radius R0 over a given radius of gyration RG and a pallet lever 1 according to the invention.

Advantageously, balance 11 includes a single roller carrying pin 12. More particularly, the single roller carrying pin 12 is formed by the felloe of balance 11.

Figure 5:
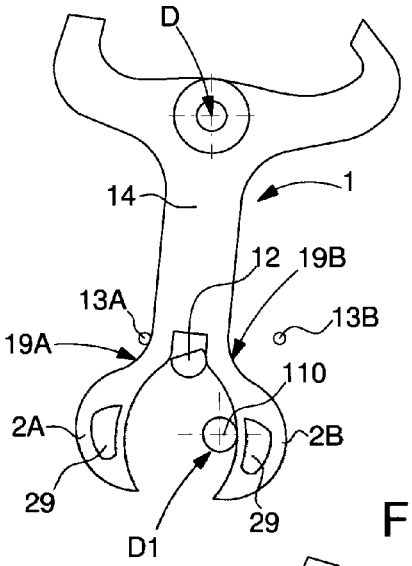
FIG. 5 shows a schematic, plan view of a Swiss lever with no guard pin having optimised horns according to the invention, in a position bearing against a stop member during an oscillation in the anti-clockwise direction.
Figure 9:
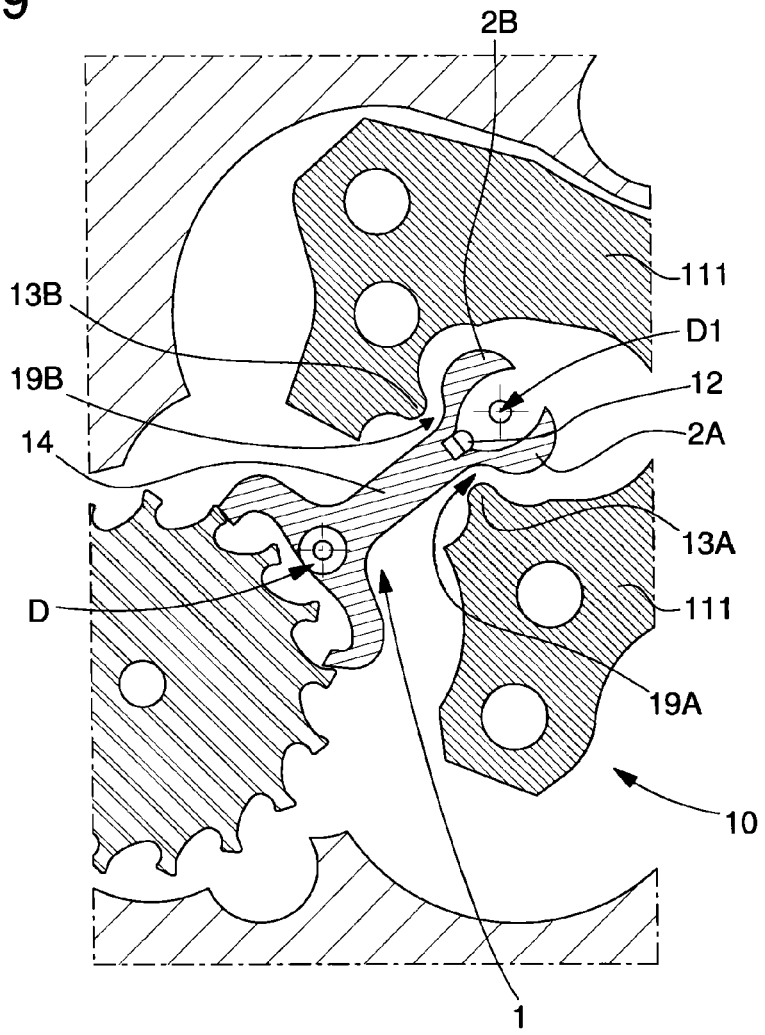
FIG. 9 shows a schematic, partial, plan view of the mechanism of FIG. 8.
Figure 10:
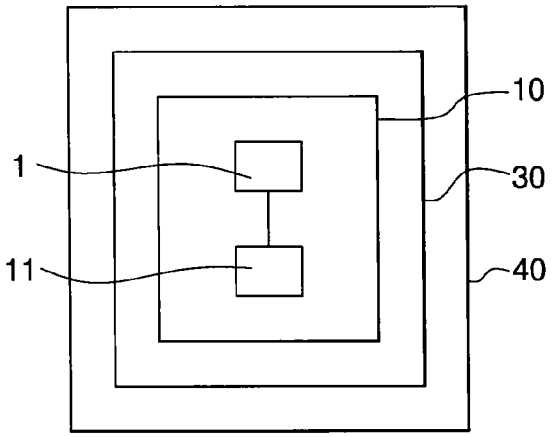
FIG. 10 shows a block diagram of a watch including a movement including an escapement mechanism according to the invention.

FIG. 9 shows a variant wherein the limit stops 13A, 13B are formed by raised portions on a bar 111 of the escapement mechanism, thus the total number of components is greatly reduced in this advantageous embodiment of the invention. Horns 2 may advantageously, as seen in FIG. 5, include recesses 29 and/or chambers, to reduce the inertia and unbalance of pallet lever 1.

The invention also concerns a mechanical timepiece movement 30 including at least one escapement mechanism 10 of this type.

The invention also concerns a timepiece 40 particularly a watch, including at least one such mechanical timepiece movement 30.

The invention has numerous advantages:

- the omission of the conventional pallet lever guard pin;
- the omission of the safety roller associated with said guard pin;
- the reduction of the risks and costs of non-quality, owing to the omission of an assembly operation;
- the reduction of the overall height of the escapement mechanism (a single pallet lever level instead of two, a single balance level instead of two or three), and therefore of the entire movement;
- freedom as to shape geometry allowing for manufacture of the pallet lever by stamping, or by DRIE—Silicon/Ni—LIGA or similar manufacture, or by plastic injection moulding;
- the possibility of driving the balance pin directly into an arm of the balance felloe, thus making the assembly of a roller unnecessary;
- the safety functions are ensured in all positions;
- the invention is applicable to every type of lever escapement, particularly the Swiss lever escapement.

What is claimed is:

1. A pallet lever for a timepiece escapement mechanism including a balance provided with a pin of a given pin radius and oscillating over a given radius of gyration, said pallet lever including, on either side of an aperture, a first horn and a second horn for cooperation with a pin of this type, wherein said first and second horns have a symmetrical profile to each other relative to a median plane passing through a pallet lever pivot axis, and each includes a concave inner profile over a first cylindrical sector bordering said aperture and having a first radius of curvature greater than or equal to a sum of said radius of gyration and said pin radius, said concave inner profile being adjacent to a convex outer profile over a second cylindrical sector having a second radius of curvature less than or equal to a difference between said radius of gyration and said pin radius and opposite said aperture.

2. The pallet lever according to claim 1, wherein said first radius of curvature is equal to a sum of said radius of gyration, said pin radius, and a horn endshake, and in that said second radius of curvature is equal to a difference between, on the one hand, said radius of gyration and on the other hand, a sum of said pin radius and said horn endshake.

3. The pallet lever according to claim 2, wherein said horn endshake is less than or equal to 0.050 mm.

4. The pallet lever according to claim 1, wherein said concave inner profile of each of said horns is centred on said concave inner profile of the opposite horn at a centre which is also that of said convex outer profile of said horn concerned.

5. The pallet lever according to claim 1, wherein the lever includes, about said horns, an outer ring limiting the pin travel, including a first inner limiting surface facing said convex outer profile of said first horn, and a second inner limiting surface facing said convex outer profile of said second first horn.

6. The pallet lever according to claim 5, wherein the space between said outer ring and said convex outer profiles is equal to twice said pin radius plus a radial play less than or equal to 0.100 mm.

7. The pallet lever according to claim 1, wherein the lever includes, on each of said concave inner profiles, a notch sized for the passage of a staff of said balance.

8. The pallet lever according to claim 1, wherein the lever includes, at the ends of said convex outer profiles closest to said pallet lever pivot axis, end of travel areas arranged to form stop members for a said pin.

9. The pallet lever according to claim 1, wherein the lever is a Swiss lever.

10. The pallet lever according to claim 1, wherein the pallet lever is flat and has no guard pin.

11. An escapement mechanism including a balance provided with a pin of a given pin radius and oscillating over a given radius of gyration about a balance pivot axis, wherein said pin cooperates with a pallet lever according to claim 1.

12. The escapement mechanism according to claim 11, wherein said balance includes a single roller carrying said pin.

13. The escapement mechanism according to claim 12, wherein said single roller carrying said pin is formed by a felloe of said balance.

14. A mechanical timepiece movement including at least one said escapement mechanism according to claim 11.

15. A watch including at least one mechanical timepiece movement according to claim 14.

* * * * *